United States Patent [19]

Wen-Shown

[11] Patent Number: 4,782,604

[45] Date of Patent: Nov. 8, 1988

[54] SOLE STRUCTURE FOR GOLF SHOES

[76] Inventor: Lo Wen-Shown, 4 Tung Pei Street, Feng Yuan city, Taichung Hsien, Taiwan

[21] Appl. No.: 67,270

[22] Filed: Jun. 26, 1987

[51] Int. Cl.[4] ..... A43B 5/00; A43C 15/00

[52] U.S. Cl. ..... 36/127; 36/59 R; 36/67 D; 36/134

[58] Field of Search ..... 36/127, 134, 59 R, 67 R, 36/67 A, 67 D, 114, 129, 67 B

[56] References Cited

U.S. PATENT DOCUMENTS

| | | | |
|---|---|---|---|
| 1,548,806 | 8/1925 | Perry | 36/129 X |
| 3,170,251 | 2/1965 | Patrick | 36/59 R |
| 3,597,863 | 8/1971 | Austin | 36/127 X |
| 3,738,026 | 6/1973 | Granger | 36/127 |
| 4,085,527 | 4/1978 | Riggs | 36/114 |
| 4,178,702 | 12/1979 | Mayer | 36/59 R |
| 4,327,503 | 5/1982 | Johnson | 36/67 A |
| 4,590,693 | 5/1986 | Kawashima et al. | 36/134 X |

FOREIGN PATENT DOCUMENTS

| | | | |
|---|---|---|---|
| 2618588 | 11/1977 | Fed. Rep. of Germany | 36/59 R |

*Primary Examiner*—James Kee Chi

*Attorney, Agent, or Firm*—Lackenbach Siegel Marzullo & Aronson

[57] ABSTRACT

The present invention provides an improved sole structure for golf shoes. It has a predetermined number of metal nails located at the front end corresponding to ball portion and the rear end corresponding to heel portion of the sole, and a plurality of soft cleats formed as integrated parts of the sole around the metal nails in order to stabilize attitude of player during striking and to provide good elasticity.

7 Claims, 2 Drawing Sheets

SOLE STRUCTURE FOR GOLF SHOES

BACKGROUND OF THE INVENTION

The present invention relates to sport shoes, particularly an improved sole structure for golf shoes.

Golf is a very popular and high class sport which emphasizes positioning of feet, aiming, rapid twisting of body and striking. Within such a series of movements, positioning just before striking is the most important one. Poor positioning will result in deviation of striking direction in spite of good aiming. Furthermore, feet must displace following twisting of body during striking, otherwise, ankle may be injured. Therefore, good golf shoes are essential. Soles of gold shoes must have good positioning effect as well as elasticity to ease twisting. However, golf shoes available at the market can be divided into two kinds: Sole with plastic cleats formed by injection, and sole with metal nails. Both of them are for adhesion to ground for positioning effect. The plastic cleats are soft, but they are not rigid enough so that adhesion to hard ground is not satisfactory, and positioning is thus affected. The metal nails provide good positioning effect by penetrating into hard ground, but do not have elasticity. Loss of elasticity may cause ankle injury when twisting. Such defects of the prior art cause trouble to manufacturers and players. Golf shoes with plastic cleats may be used as leisure and sport shoes, but that with metal nails can't be used for any purpose other than that on soil. Therefore, owner of such golf shoes may have to buy another sport shoes for leisure or other sports.

In view of such defects, the inventor, with his years of experience in this field, created this invention after a series of study, research and experiments.

SUMMARY OF THE INVENTION

The main objective of the present invention is to provide an improved sole structure for gold shoes with excellent positioning effect and good elasticity in order to provide players with the best striking conditions.

Another objective of the present invention is to provide an improved sole structure for golf shoes which can be used for playing of golf and for normal leisure and sport shoes as well.

Therefore, the improved sole structure for golf shoes according to the present invention is characterized by the installation of a plurality of removable metal nails at the front end corresponding to ball portion and at the rear end corresponding to heel portion of the sole, and forming of a plurality of soft cleats as integrated parts of the sole around the metal nails for the purpose of positioning, bearing load and providing elasticity.

DETAILED DESCRIPTION OF THE PREFERRED EMBODIMENT

Figure 1:
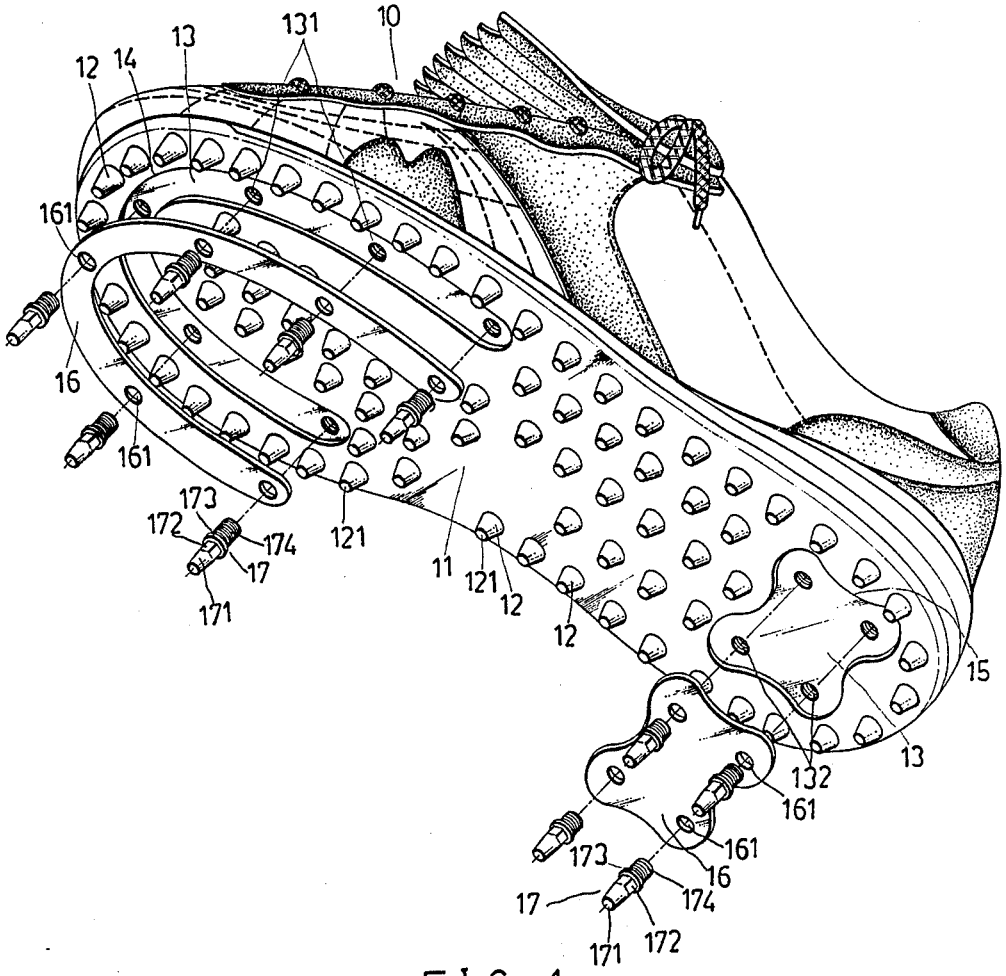
FIG. 1 is a fragmental and perspective view of a preferred embodiment according to the present invention.

Please refer to FIG. 1, the improved structure of sole for golf shoes mainly comprises a sole (11) with a plurality of soft cleats (12) which are formed parts of the sole (11) for sport shoes (10). The cleat (12) is in the form of a tapered column having a smaller circular plane (121) on the lower end for contacting with ground level.

Figure 3:
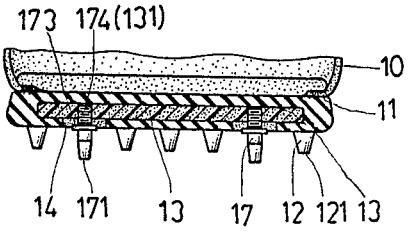
FIG. 3 is a cross-sectional view along the line A—A in FIG. 2.

A rigid element (13) is embedded in the sole (11) at a position corresponding to ball portion and another rigid element at heel portion. As shown in FIG. 3, a recession (14) in the form of a horse shoe is formed on the front end of the sole (11) corresponding to the ball portion at a predetermined distance from edge of the sole (11). As shown in FIG. 1, a recession (15) in the form substantially like a cross is formed in the middle of the rear end of the sole (11) corresponding to heel portion. Bottoms of the recessions (14) and (15) are connecting to the top of the rigid elements (13) respectively. The rigid element (13) above the recession (14) is in the form of a horse shoe and has six screw holes (131) at intervals. The rigid element (13) above the recession (15) has four screw holes (132) arranged at four equidistant opposite corners.

Each of the recessions (14)and(15) is incorporated with a soft pad (16) in the form corresponding to the recession it pits. Each of the soft pads (16) has a plurality of screw holes (161) corresponding to the screw holes (131 and 132) of the rigid element (13). As shown in FIG. 1, each of the holes (161) is penetrated by a metal nail (17) having a tip (171) at the lower end. The middle part of the flank of the metal nail (17) is cut to the form of of polygonal nut cap (172) with a circular flange (173) around its top. Male thread (174) is tapped around the top for fixing the pad (16) to the rigid element (13) by screwing through the holes (131) and (132).

Figure 2:
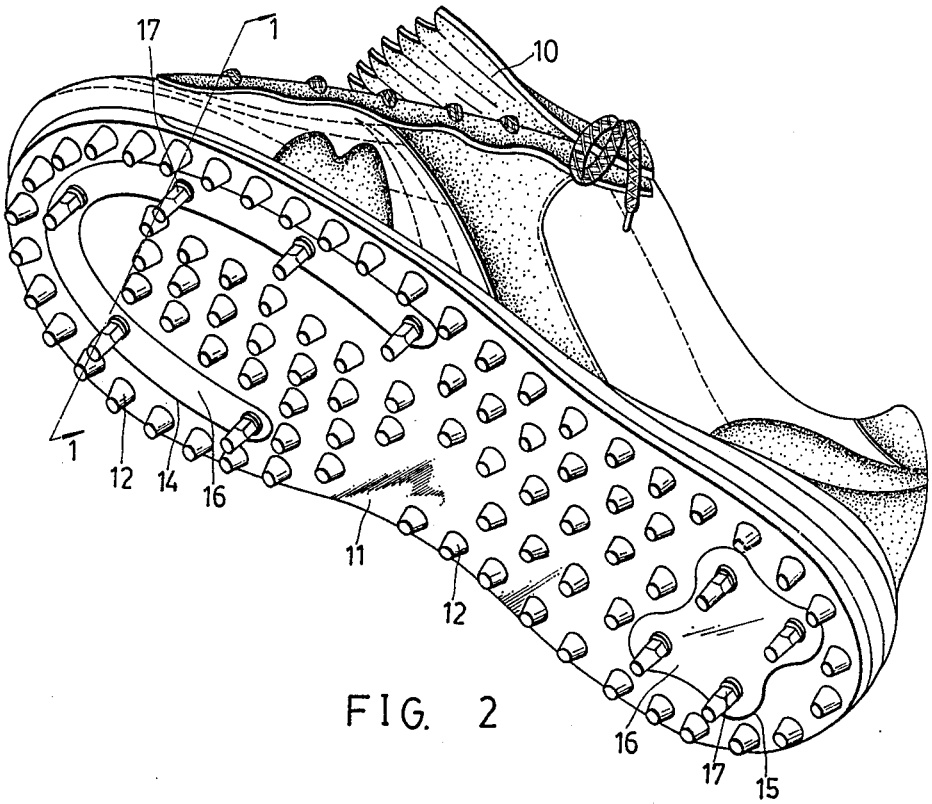
FIG. 2 is a perspective view of the preferred embodiment according to the present invention.

Assembly of the abovementioned parts can form a golf shoe of improved structure. First of all, the said two pads (16) are placed on the respective recessions (14) and (15) flatly. Then, pass respective threaded portions (174) of the metal nails (17) through the respective holes (161) of the pads (16) and screw them to the screw holes (131) and (132) of the rigid elements (13) to complete the assembly. As shown in FIG. 2, when shoes of this design are worn while playing golf, the tips (171) of the metal nails at both the front and rear ends of the sole (11) can penetrate hard soil. As shown in FIG. 3, when the front and rear metal nails (17) are penetrating into soil, the symmetrically located soft cleats (12) around margin of the sole (11) with the convergent round surface at the rear end of the sole (11) keep stable contact with ground surface. In this manner, besides maintaining stability, the sole (11) maintains its softness with the soft cleats (12). In particular, the metal nails (17) arranged in the form of a horse shoe at the front end can bear load (body weight) uniformly. With the four metal nails located on four corners at the heel portion to penetrate the soil, a stable and firm positioning effect is achieved so that player can maintain his best attitude for aiming and striking. At the moment of striking, the player twist his body and sequentially displace the sole (11). Since the sole (11) are not using only metal nails , and particularly because of the nails arranged in the form of a horse shoe which is designed to fit twisting direction, the twisting will not injure the player's ankle. Furthermore, unlike the prior art which uses only soft cleats which can restrict displacement and affect striking direction, the present invention has metal nails (17) at the front and rear ends of the sole (11) to give an appropriate restriction of degree of displacement. Therefore, in addition to give a protection to player's ankle, the present invention helps maintenance of correct striking direction.

With the front and rear recessions (14) and (15), pads (16) and particular metal nails (17) design, metal nail (17) can be removed by wrenching the nut cap (172) to separate it from the rigid element (13) for replacement of metal nail or for storage. With the metal nails (17) removed, because the recessions (14)and(15) occupy only a small space in the form of a horse shoe at the front end and another space in the form of a cross at the heel portion of the sole (11), it can be used as a normal sport shoe with soft cleats (12) distributed around the edge uniformly. The taper design with a round face on the bottom of the soft cleat (12) provides stable contact with ground and good elasticity. Therefore, the present invention can be used for leisure or sport shoes as well. It is a new invention for multiple purpose, and, of course, superior than the prior art which is used for only a single purpose.

I claim:

1. A sole structure for golf shoes having a front end and a rear end comprising a plurality of removable metal nails located at the front end corresponding to the ball portion of the sole and the rear end corresponding to the heel portion of the sole and a plurality of soft cleats formed as integrated parts of the sole around the said metal nails to bear load and to provide elasticity to golf shoes, said sole having a recession of a predetermined form with a pad of the same form for removably fixing the said metal nails.

2. An improved sole structure for golf shoe as claimed in claim 1 wherein a rigid element of a predetermined form with a plurality of screw holes is embedded at the front end of the sole, another rigid element of another predetermined form with a plurality of screw holes is embedded at the rear end of the sole for fitting the said metal nails with make threads so that the metal nails are of removable.

3. An improved sole structure for golf shoes as claimed in claim 1 wherein a section of the said metal nail is in the form of a nut cap to ease clamping and removal.

4. An improved sole structure for golf shoes as claimed in claim 1 wherein the metal nails at the front end of the sole are arranged in the form of a horse shoe corresponding to palm of foot to bear load uniformly at the front end of the sole during striking.

5. An improved sole structure for golf shoes as claimed in claim 1 wherein the metal nails at the rear end of the sole are arranged at four vertices of a cross corresponding to heel portion to provide stable support effect.

6. An improved sole structure for golf shoes as claimed in claim 1 wherein the soft cleat is in the form of a tapered column with a round place on the bottom end to keep stable contact with ground and to provide good elasticity.

7. An article of footwear comprising a shoe having the sole structure according to claim 1.

* * * * *